US007108453B2

(12) United States Patent
Harris

(10) Patent No.: US 7,108,453 B2
(45) Date of Patent: Sep. 19, 2006

(54) SUPPORT FOR CONCRETE REINFORCING MEMBERS

(76) Inventor: Terry L. Harris, 9121 Millertown Pike, Mascot, TN (US) 37806

( * ) Notice: Subject to any disclaimer, the term of this patent is extended or adjusted under 35 U.S.C. 154(b) by 183 days.

(21) Appl. No.: 10/664,760

(22) Filed: Sep. 17, 2003

(65) Prior Publication Data

US 2006/0188335 A1 Aug. 24, 2006

Related U.S. Application Data

(63) Continuation-in-part of application No. 10/126,823, filed on Apr. 19, 2002, now Pat. No. 6,663,316.

(51) Int. Cl.
*E01C 11/18* (2006.01)

(52) U.S. Cl. ..... 404/135; 404/136; 52/677; 52/687

(58) Field of Classification Search ..... 404/134, 404/135, 136; 52/677, 687
See application file for complete search history.

(56) References Cited

U.S. PATENT DOCUMENTS

| | | | | |
|---|---|---|---|---|
| 1,464,886 | A | 8/1923 | Snyder | |
| 3,255,565 | A * | 6/1966 | Menzel | 52/678 |
| 3,673,753 | A | 7/1972 | Anderson | |
| 3,693,310 | A | 9/1972 | Middleton | |
| 3,788,025 | A | 1/1974 | Holmes | |
| 4,060,954 | A * | 12/1977 | Liuzza | 52/677 |
| 4,498,270 | A | 2/1985 | Ilukowicz | |
| 4,598,523 | A | 7/1986 | Tolliver | |
| 4,835,933 | A | 6/1989 | Yung | |
| 5,107,654 | A | 4/1992 | Leonardis | |
| 5,893,252 | A | 4/1999 | Hardy, Jr. et al. | |
| 6,276,108 | B1 | 8/2001 | Padrun | |
| 6,345,474 | B1 | 2/2002 | Triplett | |
| 6,354,054 | B1 | 3/2002 | Verelli et al. | |
| D483,246 | S * | 12/2003 | McPherson et al. | D8/354 |
| 6,663,316 | B1 * | 12/2003 | Harris | 404/136 |
| 6,722,097 | B1 * | 4/2004 | Haslem et al. | 52/687 |

FOREIGN PATENT DOCUMENTS

| | | | |
|---|---|---|---|
| CA | 2252200 | * | 5/2000 |
| JP | 9-221878 | | 8/1997 |
| JP | 10-61109 | | 3/1998 |

* cited by examiner

*Primary Examiner*—Gary S. Hartmann
(74) *Attorney, Agent, or Firm*—Luedeka, Neely & Graham, P.C.

(57) ABSTRACT

A structure is described for supporting concrete reinforcement bars in a concrete structure, such as a footer or foundation. The structure includes a base member having a lower surface and an opposing upper surface. A plurality of pairs of opposing first leg members extend upward from the upper surface of the base member. Each of the first leg members have a lower end connected to the base member and an upper end distally disposed from the lower end. The structure includes a plurality of cradles for receiving the reinforcement bars, where each cradle is attached to the upper ends of a corresponding pair of the opposing first leg members. In a preferred embodiment, the structure includes horizontal support members disposed between and connecting the cradles. To retain the reinforcement bars within the cradles, preferred embodiments of the structure include retaining members that protrude inward from the inner surfaces of the opposing sidewalls. These retaining members offer interference to any upward movement of the reinforcement bars. Preferably, the base member, opposing leg members, cradles, retaining members, and horizontal support members comprise a unitary structural element, such as a continuous piece of thermoplastic material formed by injection molding.

12 Claims, 7 Drawing Sheets

SUPPORT FOR CONCRETE REINFORCING MEMBERS

This application is a continuation-in-part of patent application Ser. No. 10/126,823 filed Apr. 19, 2002 now U.S. Pat. No. 6,663,316.

TECHNICAL FIELD

The present invention is generally directed to structures for supporting concrete reinforcing members. More particularly, the invention is directed to a chair for supporting two reinforcing bars in an orthogonal relationship as concrete is poured to form a concrete slab.

BACKGROUND OF THE INVENTION

Steel reinforcement bars are typically used in concrete slabs, concrete foundations, and other concrete structures to provide structural support to the concrete. In slab applications, the bars are usually arranged in a rectangular lattice which is supported some distance above the ground or other surface on which the slab is to be poured. In foundation applications, the bars are usually arranged parallel to the walls of the foundation, and supported above the ground or other surface. In this manner, the concrete may flow under and around the bars, thereby encapsulating the bars when the concrete hardens.

Prior structures for supporting the reinforcement bars above the ground, also referred to as chairs, have been lacking in several respects. Prior chairs have not provided stable support and have not effectively captured the reinforcing members to adequately keep them in the proper position as the concrete is poured. Also, some prior chairs have been difficult to use in that multiple pieces are required to capture the reinforcement bars. Further, many prior chair designs have been difficult to fabricate, which increases their cost.

What is needed, therefore, is an easy-to-use, low-cost structure for providing stable support for reinforcement bars in concrete slabs, foundations, and other concrete structures.

SUMMARY OF THE INVENTION

The foregoing and other needs are met by an apparatus for supporting reinforcement bars in a concrete structure. The apparatus includes a base member having a lower surface and an opposing upper surface. A plurality of pairs of opposing first leg members extend upward from the upper surface of the base member. Each of the first leg members have a lower end connected to the base member and an upper end distally disposed from the lower end. The apparatus includes a plurality of cradles for receiving the reinforcement bars, where each cradle is attached to the upper ends of a corresponding pair of the opposing first leg members. In a preferred embodiment, the apparatus includes horizontal support members disposed between and connecting the cradles.

Preferably, the base member, opposing leg members, cradles, and horizontal support members comprise a unitary structural element, such as a continuous piece of thermoplastic material formed by injection molding.

BRIEF DESCRIPTION OF THE DRAWINGS

Further advantages of the invention will become apparent by reference to the detailed description of preferred embodiments when considered in conjunction with the drawings, which are not to scale, wherein like reference characters designate like or similar elements throughout the several drawings as follows.

DETAILED DESCRIPTION OF THE PREFERRED EMBODIMENT

Figure 5:
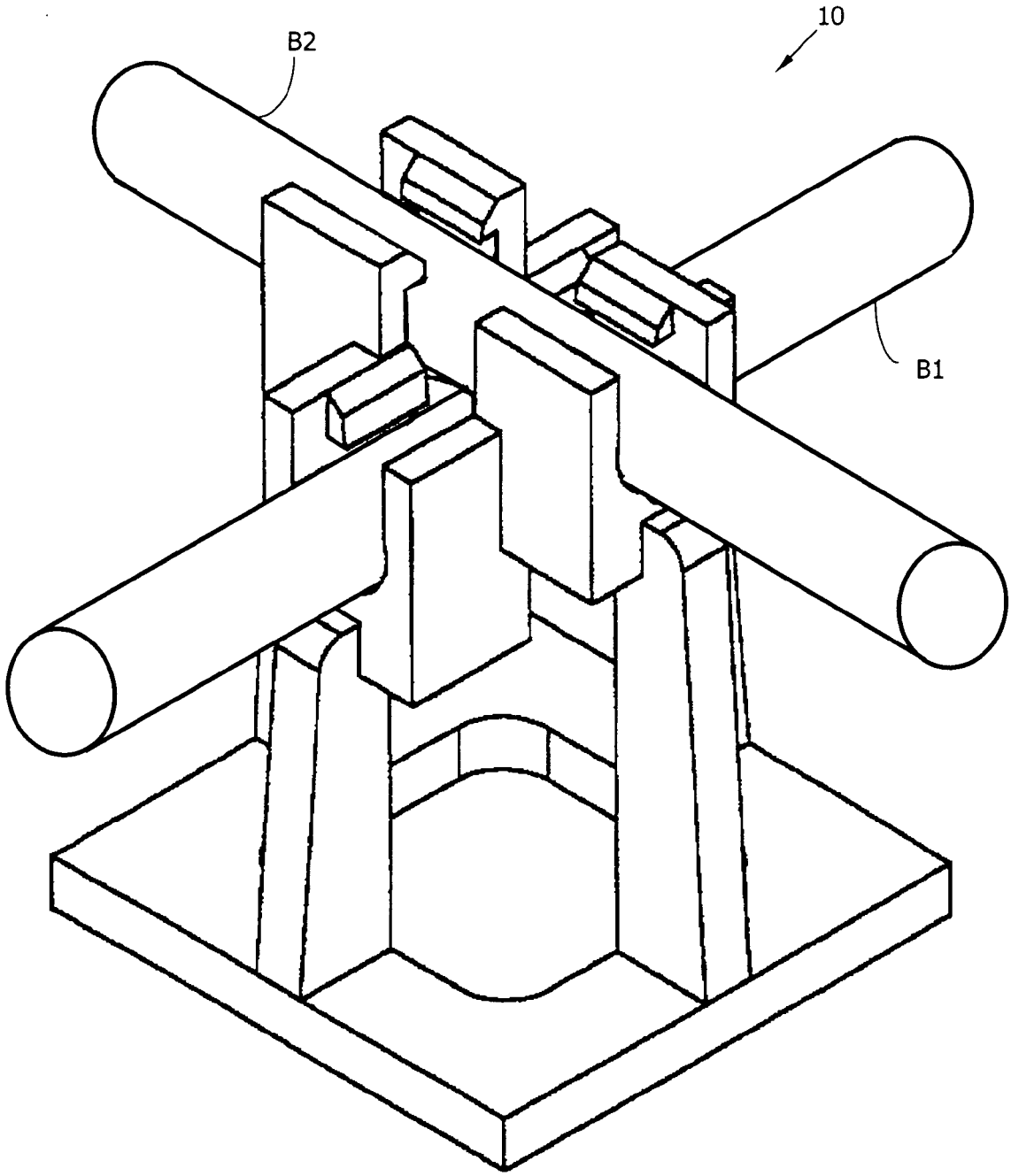
FIG. 5 is a perspective view of a structure that is supporting concrete reinforcement bars according to a preferred embodiment of the invention.

Depicted in FIGS. 1–5 is a structure 10 for supporting concrete reinforcement bars, also referred to herein as a re-bar chair. As shown in FIG. 5, the chair 10 may be used to hold two concrete reinforcement bars B1 and B2 in a substantially orthogonal relationship as concrete is poured around the chair 10 and the bars B1 and B2 to form a concrete structure. As one skilled in the art will appreciate, many such chairs 10 may be used to support a rectangular lattice of reinforcement bars in a concrete slab.

Figure 1:
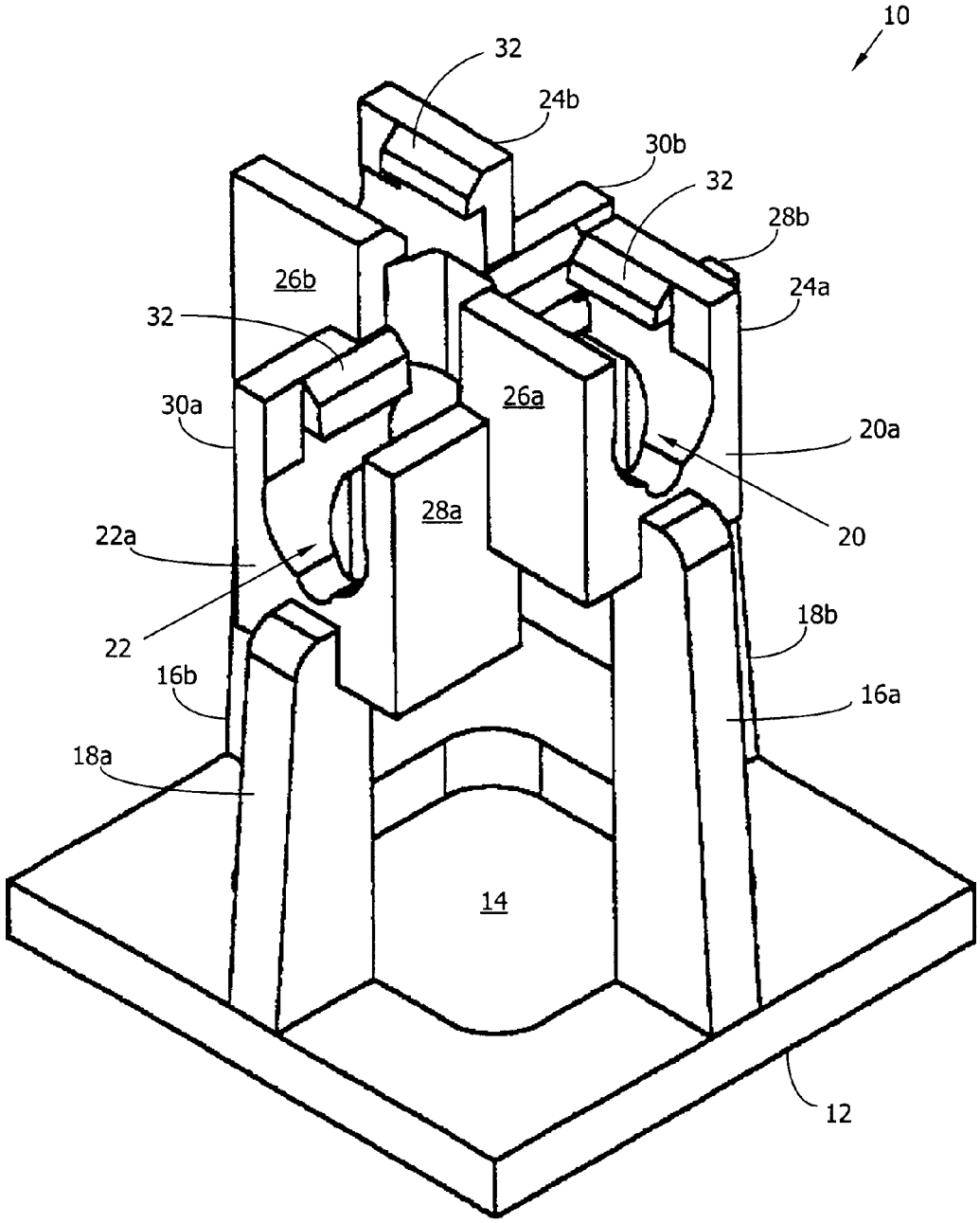
FIG. 1 is a perspective view of a structure for supporting concrete reinforcement bars according to a preferred embodiment of the invention.
Figure 2:
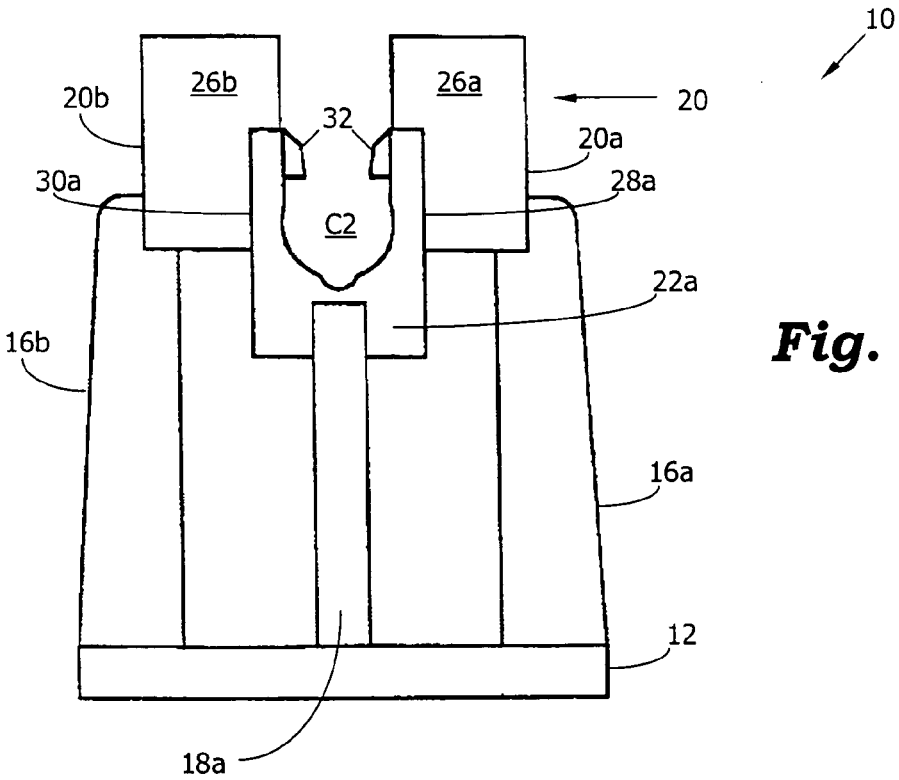
FIG. 2 is a first side view of a structure for supporting concrete reinforcement bars according to a preferred embodiment of the invention.
Figure 3:
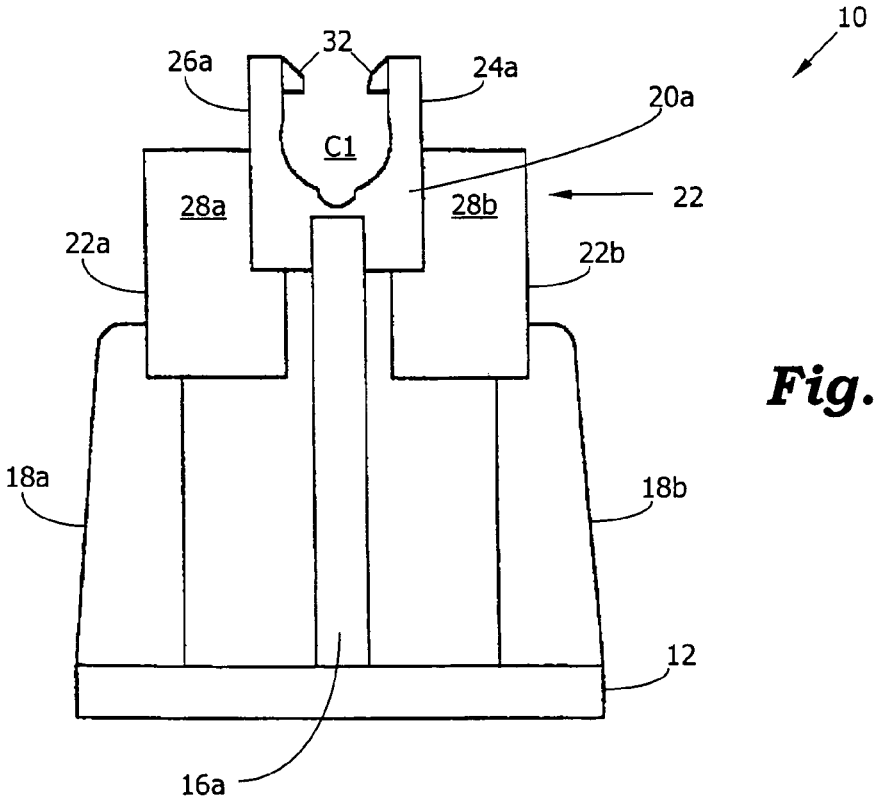
FIG. 3 is a second side view of a structure for supporting concrete reinforcement bars according to a preferred embodiment of the invention.
Figure 4:
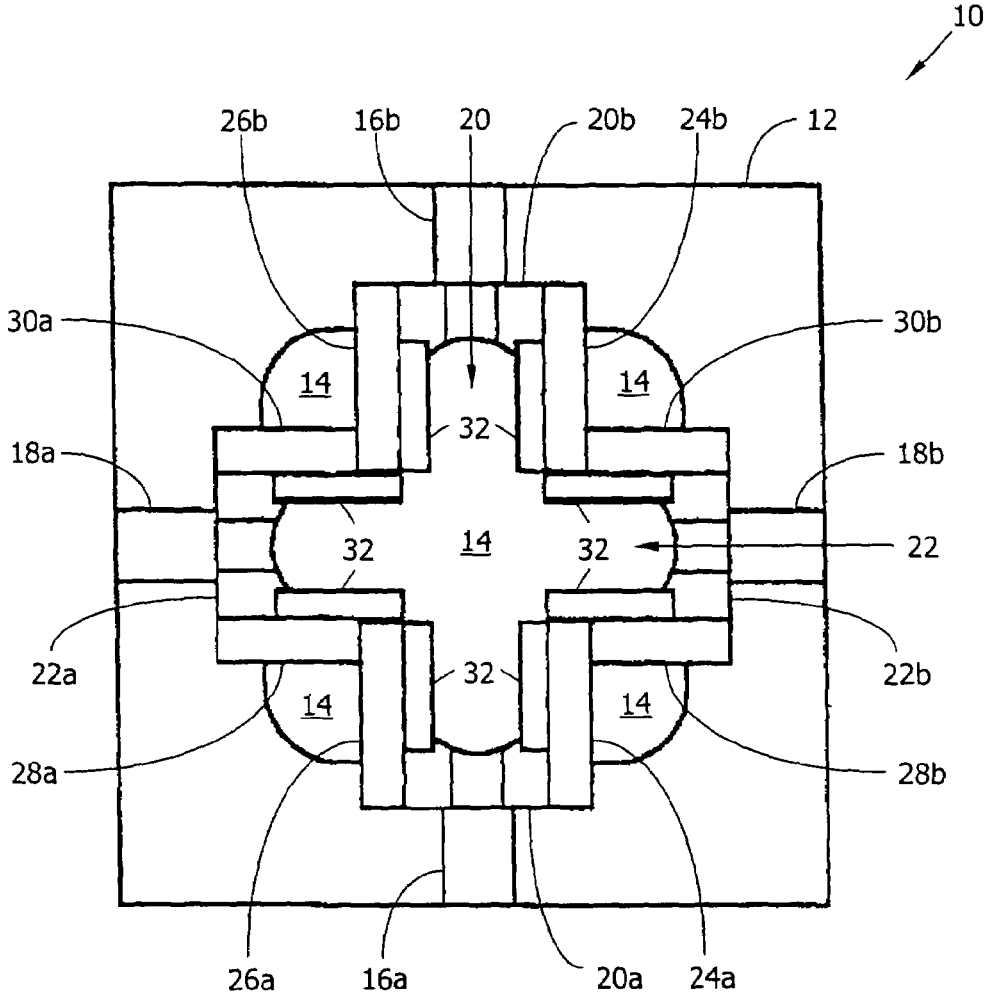
FIG. 4 is a top view of a structure for supporting concrete reinforcement bars according to a preferred embodiment of the invention.

The chair 10 includes a base member 12, which is preferably square, but which also could be circular, octagonal, or other shape. Within the base member 12, there is preferably an opening 14. Situated around the opening 14 are a set of leg members, including opposing long leg members 16*a* and 16*b* and opposing short leg members 18*a* and 18*b*. The leg members 16*a*–*b* and 18*a*–*b* are attached at their lower extremities to the base member 12 and extend upward therefrom. The leg members 16*a*–*b* and 18*a*–*b* of the preferred embodiment are rectangular in cross-section, and, as shown most clearly in FIGS. 2 and 3, are somewhat thicker at their lower extremities than at their upper extremities.

Attached to the upper extremity of the long leg member 16*a* is an upper bar-support member 20*a*, and attached to the upper extremity of the long leg member 16*b* is an upper bar-support member 20*b*. As shown most clearly in FIGS. 1 and 3, the upper bar-support member 20*a* includes opposing sidewalls 24*a* and 26*a*, which together form a channel C1 therebetween. Similarly, the upper bar-support member 20*b* includes opposing sidewalls 24*b* and 26*b*.

Attached to the upper extremity of the short leg member 18*a* is a lower bar-support member 22*a*, and attached to the upper extremity of the short leg member 18*b* is a lower bar-support member 22*b*. As shown most clearly in FIGS. 1 and 2, the lower bar-support member 22*a* includes opposing sidewalls 28*a* and 30*a*, which together form a channel C2 therebetween. Similarly, the lower bar-support member 22*b* includes opposing sidewalls 28*b* and 30*b*.

The sidewall 26*a* of the upper bar-support member 20*a* is attached to the sidewall 28*a* of the lower bar-support member 22*a*, and the sidewall 24*a* of the upper bar-support member 20*a* is attached to the sidewall 28*b* of the lower bar-support member 22*b*. Similarly, the sidewall 26*b* of the upper bar-support member 20*b* is attached to the sidewall 30*a* of the lower bar-support member 22*a*, and the sidewall 24*b* of the upper bar-support member 20*b* is attached to the sidewall 30*b* of the lower bar-support member 22*b*. Based on this arrangement, the lower bar-support members 22*a* and 22*b* form a lower cradle 22 for receiving a lower reinforcement bar (such as the bar B1 in FIG. 5), and the upper bar-support members 20*a* and 20*b* form an upper cradle 20 for receiving an upper reinforcement bar (such as the bar B2 in FIG. 5).

To prevent the reinforcement bars from lifting out of the cradles 20 and 22, on the inner surfaces of the opposing sidewalls 24*a*–26*a*, 24*b*–26*b*, 28*a*–30*a*, and 28*b*–30*b* are retaining members 32. As shown most clearly in FIGS. 2 and 3, the retaining members 32 extend slightly over the channels C1 and C2 to prevent the reinforcement bars from moving upward and out of the channels C1 and C2. As the Figures indicate, the upper surfaces of the retaining members 32 are beveled, sloped, or curved slightly downward so that when the reinforcement bars are pressed downward toward the channels C1 and C2, force is transferred outward to cause the sidewalls 24*a*–*b*, 26*a*–*b*, 28*a*–*b*, and 30*a*–*b* to flex outward and allow the reinforcement bars to snap into the channels C1 and C2. The lower surfaces of the retaining members 32 are preferably not beveled, but rather have square or barbed corners for effectively capturing the reinforcement bars within the channels C1 and C2. Compared to prior chair designs that have used opposing tapered slots in a conical or cylindrical wall, the opposing sidewalls and retaining members of the present invention provide a significantly improved retention mechanism.

In the preferred embodiment of the invention, all of the components of the chair 10 are formed from one continuous piece of thermoplastic, such as polypropylene, which, though rigid enough to support the weight of the reinforcement bars, is flexible enough to allow the sidewalls 24*a*–*b*, 26*a*–*b*, 28*a*–*b*, and 30*a*–*b* to flex outward to receive the reinforcement bars as described above. Thus, when a reinforcement bar is laid across the cradle 20 on top of the retaining members 32, and is pressed downward, the sidewalls 24*a*–*b* and 26*a*–*b* may flex outward to allow the reinforcement bar to slide past the retaining members 32 and snap into place in the channel C1. Similarly, when a reinforcement bar is laid across the cradle 22 on top of the retaining members 32, and is pressed downward, the sidewalls 28*a*–*b* and 30*a*–*b* may flex outward to allow the reinforcement bar to slide past the retaining members 32 and snap into place in the channel C2. Of course, if the chair 10 is used to support two orthogonal reinforcement bars, the lowermost bar must be snapped into the lower cradle 22 first, and then the uppermost bar may be snapped into the upper cradle 20.

In the preferred embodiment of the invention, the height of the lower cradle 22 above the base 12 is about three to four inches, which would place the reinforcement bars at about the center of a six to eight inch concrete slab. However, one skilled in the art will appreciate that with appropriate scaling of the base 12 and the leg members 16*a*–*b* and 18*a*–*b*, the height of the lower cradle 22 above the base 12 could be practically any desired value. Thus, the present invention is not limited to any particular height of the cradles 20 and 22 above the base 12.

As one skilled in the art will appreciate, the chair 10 as depicted in the Figures is designed to be formed using an injection molding process in a two-piece injection mold. For compatibility with a two-piece mold, the leg members 16*a*–*b* and 18*a*–*b* preferably lean slightly inward and have cross-sections which are preferably tapered from thicker to thinner from the lower to the upper extremities.

Figure 7:
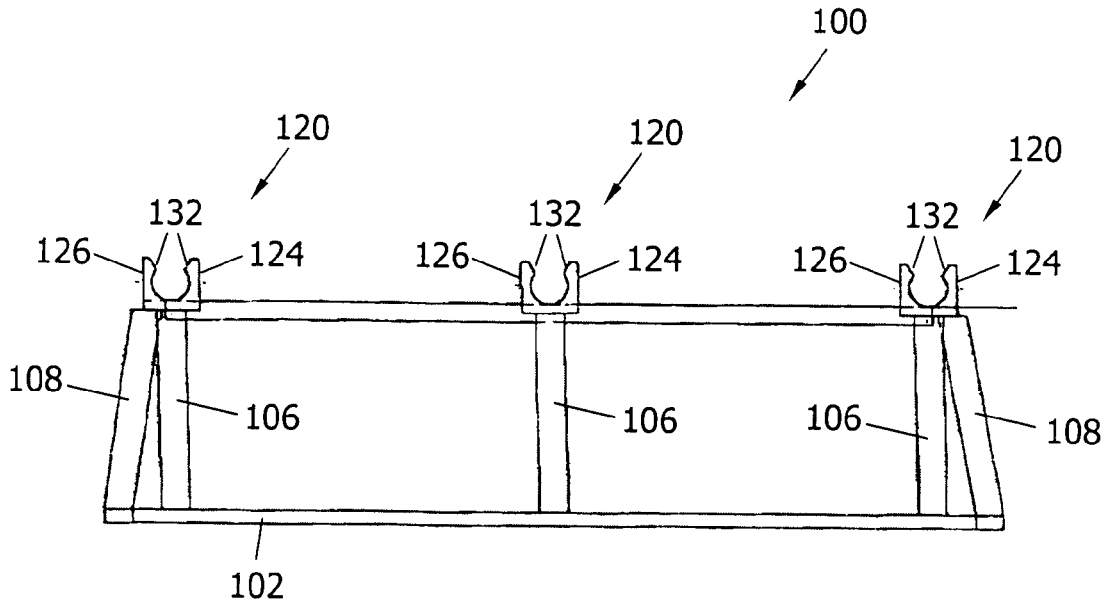
FIG. 7 is a side view of a structure for supporting concrete reinforcement bars according to an alternative embodiment of the invention.
Figure 8:
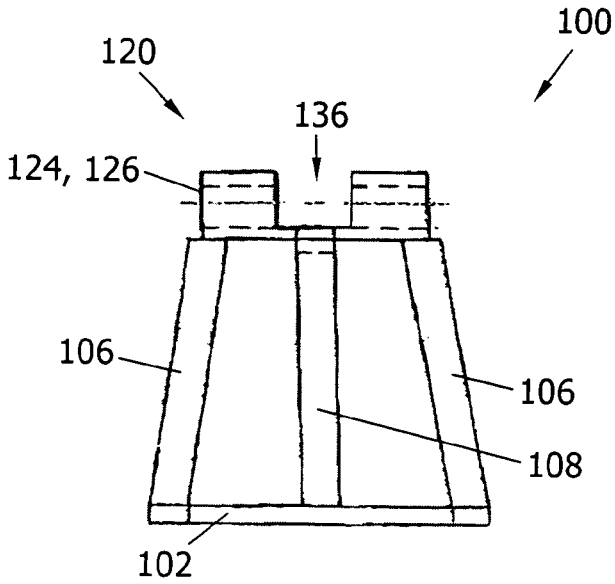
FIG. 8 is an end view of a structure for supporting concrete reinforcement bars according to an alternative embodiment of the invention.
Figure 9:
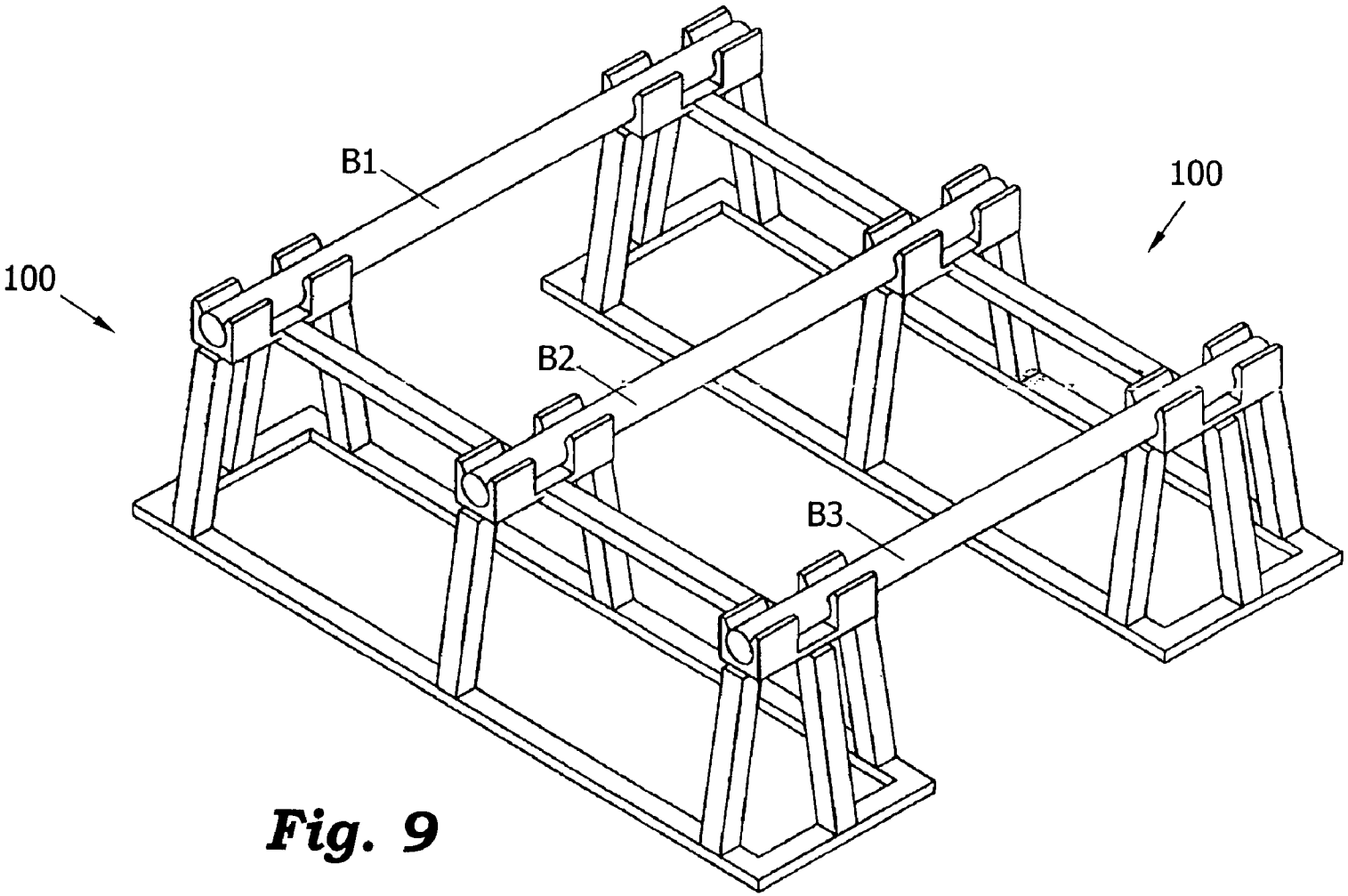
FIG. 9 is a perspective view of a structure that is supporting concrete reinforcement bars according to an alternative embodiment of the invention.

Depicted in FIGS. 6–9 is an alternative embodiment of a structure 100 for supporting concrete reinforcement bars, also referred to herein as a re-bar chair. As shown in FIG. 9, the a preferred embodiment of the chair 100 may be used to hold three concrete reinforcement bars B1, B2, and B3 in a substantially parallel relationship as concrete is poured around the chair 100 and the bars B1, B2, and B3 to form a concrete structure, such as a foundation or footer. As one skilled in the art will appreciate, many such chairs 100 may be used to support several reinforcement bars in a concrete foundation.

The chair 100 includes a base member 102, which is preferably rectangular, but which also could be oval, elliptical, or other shape. Within the base member 102, there is preferably an opening 104. Situated around the opening 104 are a set of leg members 106 and 108. The leg members 106 and 108 are attached at their lower extremities to the base member 102 and extend upward there from. The leg members 106 and 108 of the preferred embodiment are rectangular in cross-section, and are somewhat thicker at their lower extremities than at their upper extremities.

Figure 6:
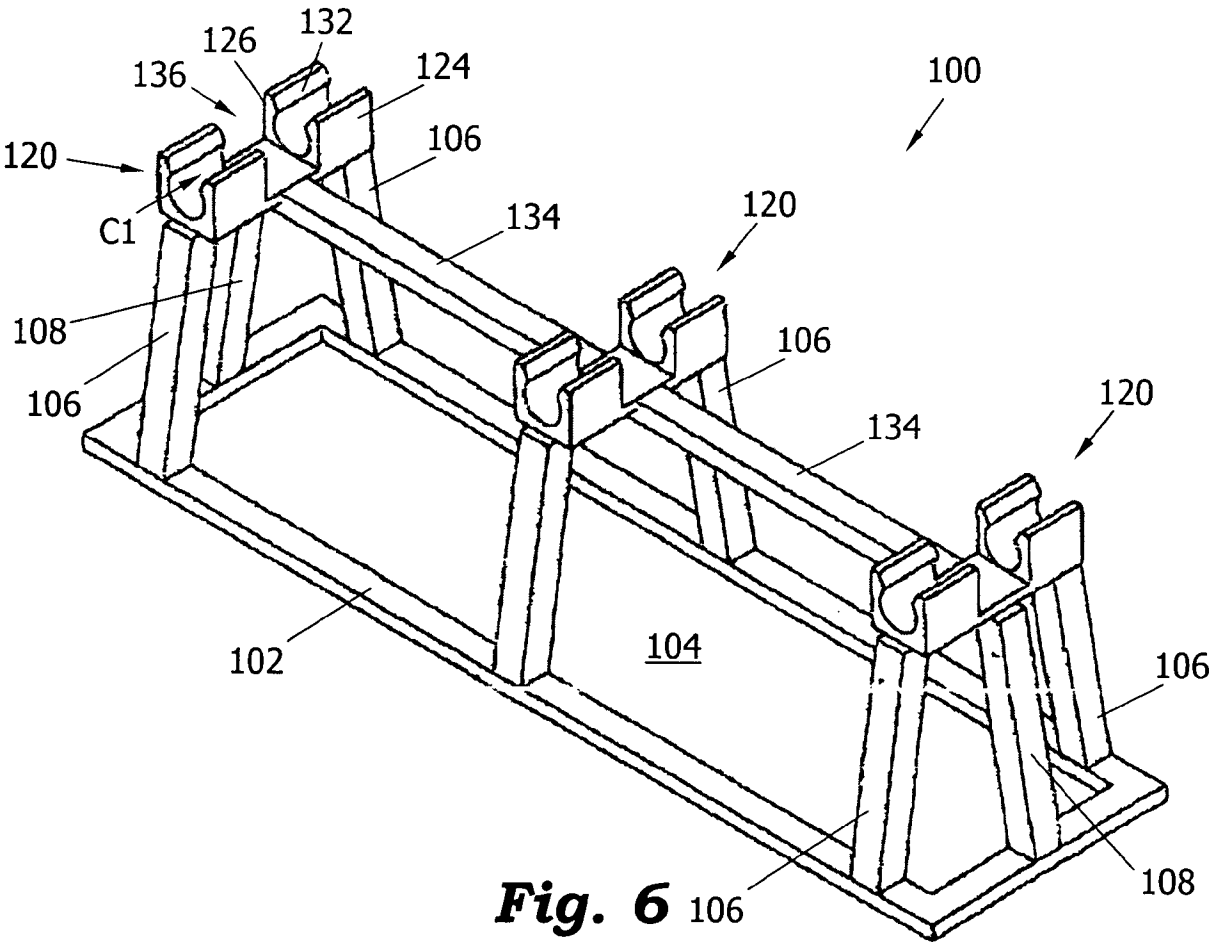
FIG. 6 is a perspective view of a structure for supporting concrete reinforcement bars according to an alternative embodiment of the invention.

Attached to the upper extremity of each pair of leg members 106 is a cradle 120. Each cradle 120 preferably includes opposing sidewalls 124 and 126 which form a channel C1 in which a reinforcement bar (such as the bar B1 in FIG. 9) is received. Preferably the sidewalls 124 and 126 of the cradles 120 include a gap 136, as depicted in FIGS. 6 and 8. However, in an alternative embodiment, the sidewalls 124 and 126 have no gap. One advantage of the embodiment with the gap 136 is that the sidewalls 124 and 126 are easier to flex outward to allow insertion of the reinforcement bars into the channel C1.

To prevent the reinforcement bars from lifting out of the cradles 120, on the inner surfaces of the opposing sidewalls 124 and 126 are retaining members 132. As shown most clearly in FIGS. 6 and 7, the retaining members 132 extend slightly over the channel C1 to prevent the reinforcement bars from moving upward and out of the channel C1. As the Figures indicate, the upper surfaces of the retaining members 132 are preferably beveled, sloped, or curved slightly downward so that when the reinforcement bars are pressed downward toward the channel C1, force is transferred outward to cause the sidewalls 124 and 126 to flex outward and allow the reinforcement bars to snap into the channel C1. The lower surfaces of the retaining members 132 are preferably not beveled, but rather have square or barbed corners for effectively capturing the reinforcement bars within the channel C1. Compared to prior chair designs that have used opposing tapered slots in a conical or cylindrical wall, the opposing sidewalls and retaining members of the present invention provide a significantly improved retention mechanism.

The preferred embodiment of the chair 100 includes three cradles 120 for holding three reinforcement bars. However, one skilled in the art will appreciate that the chair 100 may include any number of cradles 120 to hold any number of reinforcement bars in a parallel arrangement in a concrete foundation or footer.

As shown in FIGS. 6 and 7, horizontal support members 134 are preferably provided between adjacent cradles 120 to provide lateral support.

In the preferred embodiment of the invention, all of the components of the chair 102 are formed from one continuous piece of thermoplastic, such as polypropylene, which, though rigid enough to support the weight of the reinforcement bars, is flexible enough to allow the sidewalls 124 and 126 to flex outward to receive the reinforcement bars as described above. Thus, when a reinforcement bar is laid across the cradle 120 on top of the retaining members 132, and is pressed downward, the sidewalls 124 and 126 may flex outward to allow the reinforcement bar to slide past the retaining members 132 and snap into place in the channel C1.

In the preferred embodiment of the invention depicted in FIGS. 6–9, the height of the cradles 120 above the base 102 is about 3 to 4 inches, which would place the reinforcement bars at about the center of a 6 to 8 inch concrete foundation. However, one skilled in the art will appreciate that with appropriate scaling of the base 102 and the leg members 106 and 108, the height of the cradles 120 above the base 102 could be practically any desired value. Thus, the present invention is not limited to any particular height of the cradles 120 above the base 102.

The spacing between adjacent cradles 120 is about five inches in the preferred embodiment that has three cradles. This provides for a spacing of about ten inches between the outer two cradles 120, which is an optimum arrangement for 12-inch wide footers. However, it will be appreciated that the invention is not limited to any particular spacing between adjacent cradles 120.

As one skilled in the art will appreciate, the chair 100 as depicted in FIGS. 6–9 is designed to be formed using an injection molding process in a two-piece injection mold. For compatibility with a two-piece mold, the leg members 106 and 108 preferably lean slightly inward and have cross-sections which are preferably tapered from thicker to thinner from the lower to the upper extremities.

The foregoing description of preferred embodiments for this invention have been presented for purposes of illustration and description. They are not intended to be exhaustive or to limit the invention to the precise form disclosed. Obvious modifications or variations are possible in light of the above teachings. The embodiments are chosen and described in an effort to provide the best illustrations of the principles of the invention and its practical application, and to thereby enable one of ordinary skill in the art to utilize the invention in various embodiments and with various modifications as is suited to the particular use contemplated. All such modifications and variations are within the scope of the invention as determined by the appended claims when interpreted in accordance with the breadth to which they are fairly, legally, and equitably entitled.

What is claimed is:

1. An apparatus for supporting at least first and second reinforcement bars in a concrete structure, the apparatus comprising:

a base member having a lower surface and an opposing upper surface;

a first leg members extending upward from the upper surface of the base member, the first leg members having a lower end connected to the base member and an upper end distally disposed from the lower end;

a second leg member extending upward from the upper surface of the base member, the second leg member having a lower end connected to the base member and an upper end distally disposed from the lower end;

at least a first cradle attached to the upper end of the first leg member, the first cradle for holding the first reinforcement bar only; and at least a second cradle attached to the upper end of the second leg members, the second cradle for holding the second reinforcement bars only, wherein the second reinforcement bar is held in a position substantially parallel to the first reinforcement bars held in the first cradles.

2. The apparatus of claim 1, wherein first and second cradles each comprises a pair of opposing sidewalls separated by a channel.

3. The apparatus of claim 1 further comprising:

the base member having a first end and a second end;

a first pair of first leg members disposed adjacent the first end of the base member;

a second pair of second leg members disposed adjacent the second end of the base member;

the first cradle attached to the upper ends of the first pair of first leg members;

the second cradle attached to the upper ends of the second pair of second leg members;

a third leg member extending upward from the upper surface of the first end of the base member, the third leg member having a lower end connected to the base member and an upper end connected to the first cradle; and a fourth leg member extending upward from the upper surface of the second end of the base member, the fourth leg member having a lower end connected to the base member and an upper end connected to the second cradle.

4. The apparatus of claim 3 wherein the base member has a central opening disposed between the first leg members in the first pair, between the second leg members in the second pair, and between the third and fourth leg members.

5. The apparatus of claim 3 wherein the lower ends of the first leg members in the first pair are spaced farther apart than are the upper ends of the first leg members, the lower ends of the second leg members in the second pair are spaced farther apart than are the upper ends of the second leg members, and the lower ends of the third and fourth leg members are spaced farther apart than are the upper ends of the third and fourth leg members.

6. The apparatus of claim 1 further comprising horizontal support members disposed between the first and second cradles.

7. The apparatus of claim 2 further comprising retaining members protruding inwardly from the opposing sidewalls of the first cradle to retain the first reinforcement bar within the channel.

8. The apparatus of claim 1 wherein the base member, first and second leg members, and first and second cradles comprise a unitary structural element.

9. The apparatus of claim 1 wherein the base member, first and second leg members, and first and second cradles are formed from a continuous piece of thermoplastic material.

10. An apparatus for supporting reinforcement bars in a concrete structure, the apparatus comprising:

a base member having a lower surface, an opposing upper surface, a first end and a second end;

a plurality of pairs of opposing first leg members extending upward from the upper surface of the base member, each of the first leg members having a lower end connected to the base member and an upper end distally disposed from the lower end;

a first pair of the plurality of pairs of opposing first leg members disposed adjacent the first end of the base member;

a second pair of the plurality of pairs of opposing first leg members disposed adjacent the second end of the base member;

a plurality of cradles, each cradle attached to the upper ends of a corresponding pair of the plurality of pairs of opposing first leg members, each cradle for receiving a reinforcement bar;

a first cradle of the plurality of cradles, the first cradle attached to the upper ends of the first pair of opposing first leg members;

a second cradle of the plurality of cradles, the second cradle attached to the upper ends of the second pair of opposing first leg members;

a second leg member extending upward from the upper surface of the first end of the base member, the second leg member having a lower end connected to the base member and an upper end connected to the first cradle; and a third leg member extending upward from the upper surface of the second end of the base member, the third leg member having a lower end connected to the base member and an upper end connected to the second cradle.

11. The apparatus of claim 10 wherein the base member has a central opening disposed between the first pair of opposing first leg members, between the second pair of opposing first leg members, and between the second and third leg members.

12. The apparatus of claim 10 wherein the lower ends of the opposing first leg members within each of the plurality of pairs are spaced farther apart than are the upper ends of the opposing first leg members, and the lower ends of the second and third leg members are spaced farther part than are the upper ends of the second and third leg members.

* * * * *